US006173861B1

(12) United States Patent
Houry

(10) Patent No.: US 6,173,861 B1
(45) Date of Patent: Jan. 16, 2001

(54) WASTE CONTAINER ASSEMBLY

(75) Inventor: Robert L. Houry, Chesterfield, MO (US)

(73) Assignee: Contico International, LLC, St. Louis, MO (US)

( * ) Notice: Under 35 U.S.C. 154(b), the term of this patent shall be extended for 0 days.

(21) Appl. No.: 09/255,150

(22) Filed: Feb. 22, 1999

(51) Int. Cl.[7] ..... B65D 25/30; B65D 43/16

(52) U.S. Cl. ..... 220/828; 220/475; 220/825; 220/836; 220/840; 220/675; 220/771; 220/908

(58) Field of Search ..... 220/828, 495.06, 220/495.07, 495.08, 495.09, 495.11, 213, 254, 263, 264, 262, 810, 836, 827, 908, 908.3, 475, 495.1, 825, 840, 675, 771

(56) References Cited

U.S. PATENT DOCUMENTS

D. 126,632 4/1941 Perkins .
D. 187,305 2/1960 Tocci .
D. 197,150 12/1963 Marsh .
D. 200,360 2/1965 Deisner .
D. 201,526 6/1965 Martino .
D. 208,955 10/1967 McAllister .
D. 214,398 6/1969 Pipolo .
D. 216,739 3/1970 Marsh .
D. 231,426 4/1974 Mele .
D. 270,677 9/1983 Creske .
D. 271,248 11/1983 Maza et al. .
D. 280,459 9/1985 McClelland .
D. 280,857 10/1985 Fuiler et al. .
D. 281,111 10/1985 McClelland .
D. 293,843 1/1988 Kroll et al. .
D. 321,576 11/1991 Hradisky .
D. 331,134 11/1992 Hradisky .
D. 333,716 3/1993 Bird et al. .
D. 335,565 5/1993 Juergens .
D. 343,267 1/1994 Craft et al. .
D. 358,918 5/1995 Gale .
D. 370,108 5/1996 Brightbill et al. .
D. 391,727 3/1998 Delmerico .
D. 391,728 3/1998 Delmerico .

(List continued on next page.)

*Primary Examiner*—Allan N. Shoap
*Assistant Examiner*—Niki M. Eloshway
(74) *Attorney, Agent, or Firm*—Howell & Haferkamp, L.C.

(57) ABSTRACT

A waste container assembly comprises a container body, a lid body, a flange and a door. The container body has an upper rim. The lid body has an outer surface extending from a top of the lid body to a lower portion of the lid body. The lower portion of the lid body is shaped and adapted for engagement with the upper rim of the container body. The flange extends from the lid body and has an inner rim that at least partially defines an opening in the lid body. The door is positioned adjacent the opening in the lid body and is pivotally connected to the flange for selectively moving the door between open and closed positions relative to the lid body. The door is adapted to substantially cover the opening in the lid body when the door is in its closed position. In another embodiment, the door pivots about a pivot axis and has a rim engaging portion adapted for engagement with the inner rim of the lid body when the door is in its closed position. The door and lid body are configured so that the pivot axis is spaced outwardly from a vertical plane that passes through at least a portion of the inner rim of the lid body. In yet another embodiment, a waste container assembly comprises a container body and a lid assembly, which includes a monolithic door pivotally connected to a monolithic lid body. In still another embodiment, a waste container assembly comprises a container body and a boss. The container body has a bottom and at least one side wall extending upwardly from the bottom. The side wall at least partially defines a container interior. The boss extends from an exterior surface of the container side wall. The boss has a hole adapted to receive a portion of a retaining member for securing the waste container assembly to a secure object.

14 Claims, 5 Drawing Sheets

U.S. PATENT DOCUMENTS

| | | | |
|---|---|---|---|
| D. 391,729 | | 3/1998 | Delmerico . |
| 1,212,321 | | 1/1917 | Buchholz . |
| 1,333,051 | | 3/1920 | Young . |
| 1,552,027 | | 9/1925 | Baxter . |
| 1,605,043 | | 11/1926 | Langford . |
| 1,646,623 | | 10/1927 | McConnell . |
| 1,964,513 | | 6/1934 | Hammer . |
| 1,984,228 | | 12/1934 | Morhous . |
| 3,219,227 | | 11/1965 | Deisner . |
| 3,306,486 | | 2/1967 | Martino et al. . |
| 3,394,832 | | 7/1968 | McAllister . |
| 3,799,391 | | 3/1974 | Brescia . |
| 3,836,036 | | 9/1974 | Hodge . |
| 4,032,037 | | 6/1977 | Dubery et al. . |
| 4,095,712 | | 6/1978 | Perrella . |
| 4,234,096 | | 11/1980 | Hergaux . |
| 4,331,074 | | 5/1982 | Behman . |
| 4,776,478 | | 10/1988 | Miller et al. . |
| 4,964,523 | | 10/1990 | Bieltvedt et al. . |
| 5,163,574 | | 11/1992 | Sosan . |
| 5,170,904 | | 12/1992 | Neuhaus . |
| 5,172,823 | * | 12/1992 | Moetteli ..... 220/908 X |
| 5,183,175 | | 2/1993 | Brown . |
| 5,219,085 | | 6/1993 | Craft et al. . |
| 5,292,023 | | 3/1994 | Yen . |
| 5,295,607 | | 3/1994 | Chang . |
| 5,335,805 | | 8/1994 | Chen . |
| 5,494,186 | | 2/1996 | Marsh . |
| 5,582,322 | * | 12/1996 | Prout et al. ..... 220/908 X |

* cited by examiner

WASTE CONTAINER ASSEMBLY

BACKGROUND OF THE INVENTION

The present invention pertains to waste, trash and refuse containers for indoor and outdoor use. More particularly, a waste container assembly of the present invention is of the general type having a container body with a closed lid and a swinging lid door for accessing an interior of the container body.

Waste container assembies having lids with swinging doors are common commercial and household items. Such containers typically comprise a waste receptacle with an upper rim, a lid dimensioned to rest on or fit over the upper rim to close the receptacle, and a door pivotably connected to the lid for providing access to an interior of the waste receptacle. Such container assemblies are frequently used outdoors where they may be exposed to rain and other environmental elements. Lids with pivoting doors make it easy for a user to deposit waste into the container, without leaving the container interior exposed to rainwater and other environmental elements. Such lid assemblies also help to keep debris and odors inside the container.

One such prior art lid assembly includes a lid with a generally dome-shaped exterior that directs rain water thereover to the outside of the waste container. A recess formed in a forward portion of the domed lid extends inwardly and terminates at an inward vertical opening. A mounting bracket is mechanically fastened to an upper portion of an interior surface of the domed lid above the opening. A door is pivotally mounted to the mounting bracket for swinging movement inwardly and outwardly to open and close the lid opening. In another prior art lid assembly, the lid further comprises at least one metal spring for biasing the door outwardly toward its closed position.

A problem with conventional waste container assemblies is that numerous parts, including mounting brackets, mechanical fasteners, and springs are required for pivotally mounting the door to the lid body and for biasing the door toward a closed position. Such multi-component assemblies add to manufacturing and labor cost, and make for a cumbersome assembly process. Also, metal components, such as mounting brackets, mechanical fasteners and springs are susceptible to corrosion, especially when such assemblies are used outdoors for extended periods of time. Waste container assemblies having metal components can also be rather noisy (e.g., a spring-biased metal door returning quickly to its closed position and crashing against the metal rim of the lid, squeeky metal springs or pivot pins, etc.) making them undesireable for use in quiet places, such as hospitals or libraries. Another shortcoming of conventional waste container assemblies is that they do not incorporate a simple and effective means for anchoring or otherwise securing the container assembly to a secure object, so as to prevent theft and to prevent overturning due to adverse weather conditions, such as high winds.

SUMMARY OF THE INVENTION

The present invention overcomes the shortcomings of the prior art by providing a waste container assembly having a simple but effective construction. An object of the invention is to provide a functional waste container assembly with a minimal number of parts. Another object is to provide a waste container assembly having components that arc quieter during operation and less susceptible to corrosion. Yet another object is to provide a waste container assembly that incorporates a simple but effective means for anchoring or securing the container assembly to a secure object. Another general object is to provide a waste container assembly that is less costly to manufacture and that can be easily assembled and disassembled without tools.

In general, a waste container assembly of the present invention comprises a container body, a lid body, a flange and a door. The container body has an upper rim. The lid body has an outer surface extending from a top of the lid body to a lower portion of the lid body. The lower portion of the lid body is shaped and adapted for engagement with the upper rim of the container body. The flange extends from the lid body and has an inner rim that at least partially defines an opening in the lid body. The door is positioned adjacent the opening in the lid body and is pivotally connected to the flange for selectively moving the door between open and closed positions relative to the lid body. The door is adapted to substantially cover the opening in the lid body when the door is in its closed position.

In another aspect of the present invention, a waste container assembly comprises a container body, a lid body and a door pivotally connected to the lid body. The lid body has an inner rim that at least partially defines an opening in the lid body. The door is pivotally connected to the lid body for pivoting movement of the door between open and closed positions relative to the lid body about a pivot axis. The door has a rim engaging portion adapted for engagement with the inner rim of the lid body when the door is in its closed position. The door and lid body are configured so that the pivot axis is spaced outwardly from a vertical plane that passes through at least a portion of the inner rim.

In yet another aspect of the present invention, a waste container assembly comprises a container body and a lid assembly, which includes a monolithic lid body and a monolithic door. The monolithic lid body has a generally closed upper portion and a container engaging lower portion. The lower portion of the lid body is shaped and adapted for engagement with an upper rim of the container body. The upper portion of the lid body has an opening. The monolithic door is pivotally connected to the lid body for pivoting movement of the door between open and closed positions relative to the lid body about a pivot axis. The door is adapted to substantially cover the opening in the lid body when the door is in its closed position.

In still another aspect of the present invention, a waste container assembly comprises a container body and a boss. The container body has a bottom and at least one side wall extending upwardly from the bottom. The side wall at least partially defines a container interior. The boss extends from an exterior surface of the container side wall. The boss has a hole adapted to receive a portion of a retaining member for securing the waste container assembly to a secure object.

Other objects and features will be in part apparent and in part pointed out hereinafter.

BRIEF DESCRIPTION OF THE DRAWINGS

Reference characters in the written specification indicate corresponding parts throughout the several views of the drawings.

DETAILED DESCRIPTION OF THE PREFERRED EMBODIMENTS

Figure 1:
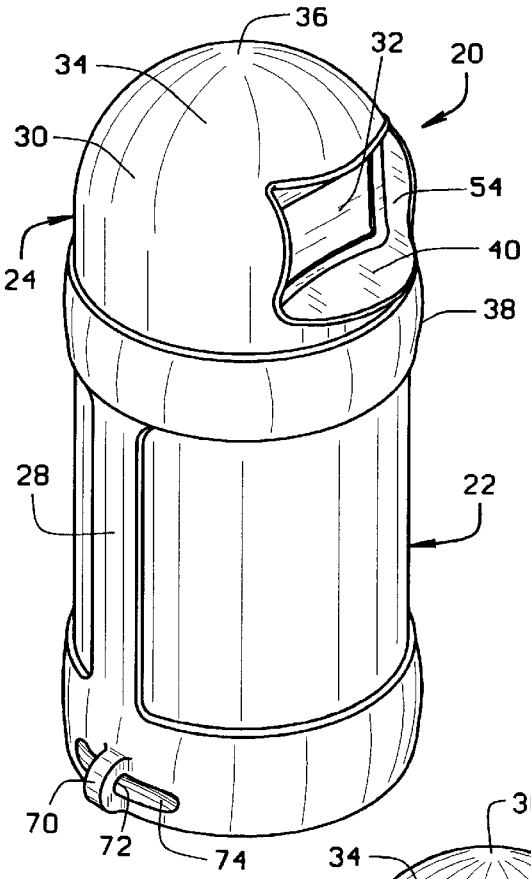
FIG. 1 is a perspective view of a waste container assembly of the present invention.
Figure 2:
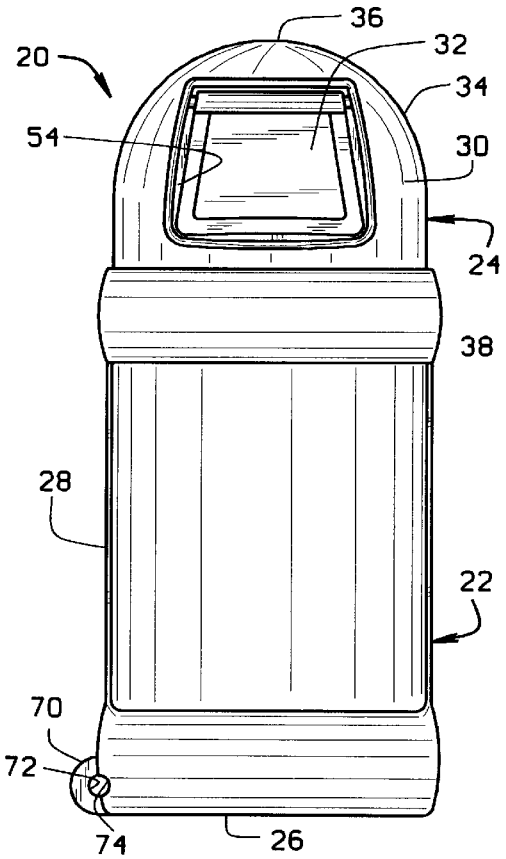
FIG. 2 is a front elevational view of the waste container assembly of FIG. 1.
Figure 3:
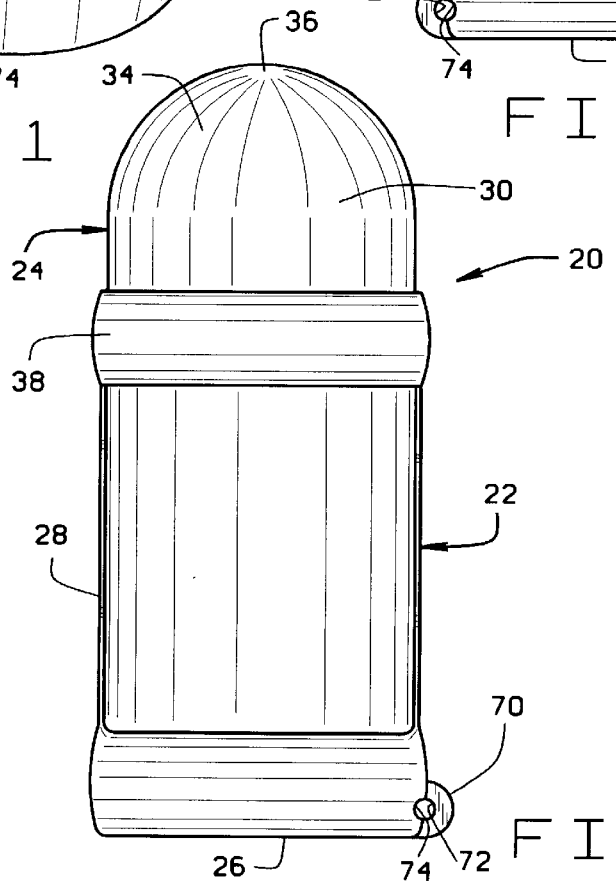
FIG. 3 is a rear elevational view of the waste container assembly of FIG. 1.
Figure 4:
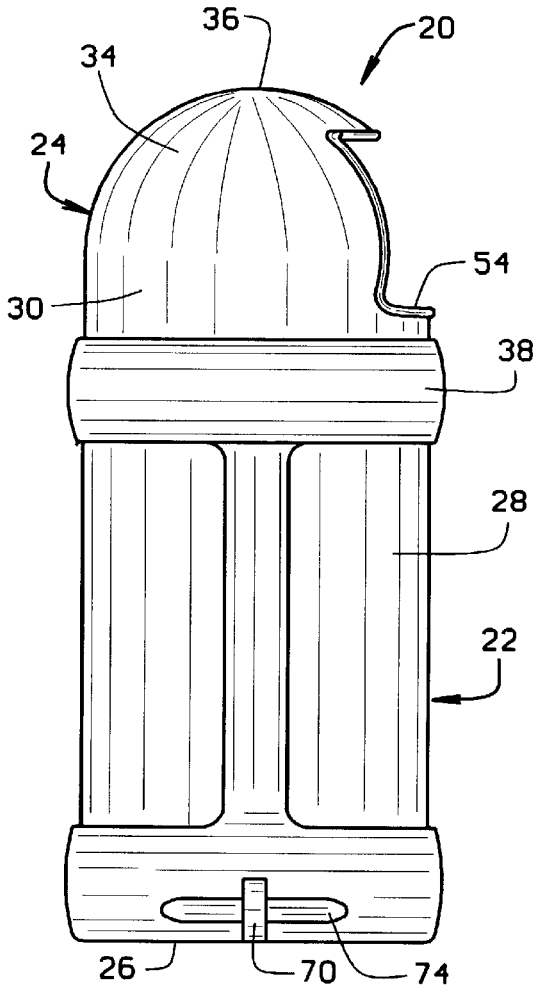
FIG. 4 is a right end elevational view of the waste container assembly of FIG. 1.
Figure 5:
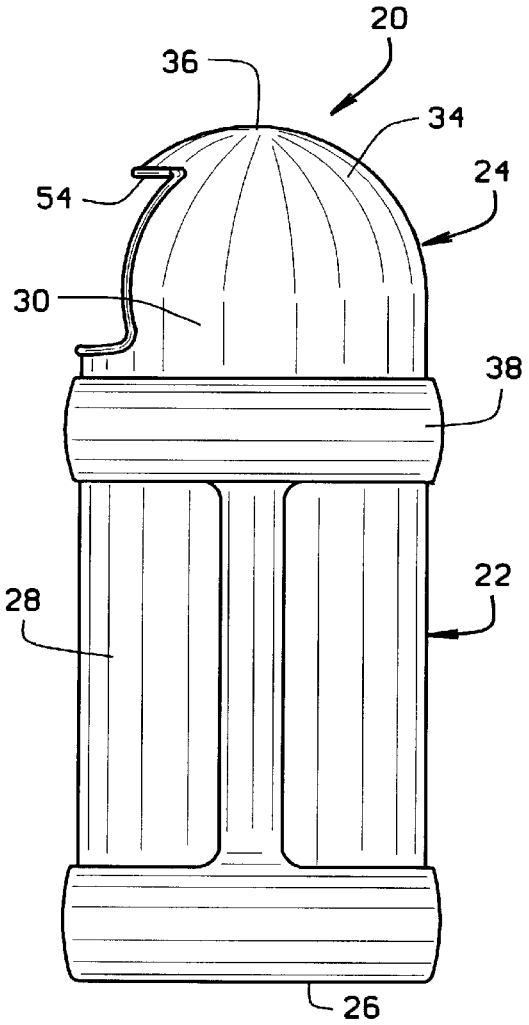
FIG. 5 is a left end elevational view of the waste container assembly of FIG. 1.
Figure 6:
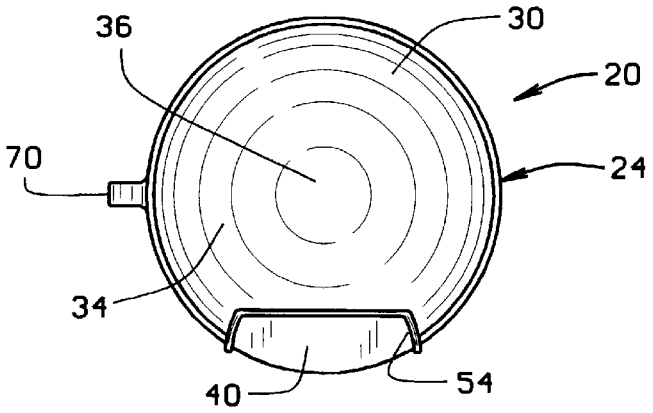
FIG. 6 is a top plan view of the waste container assembly of FIG. 1.

A waste container assembly of the present invention is indicated generally in FIGS. 1–6 by the reference numeral 20. The waste container assembly 20 broadly includes a container body 22 and a lid assembly 24. The container body 22 has a generally flat bottom wall 26 and at least one side wall 28 extending upwardly from the bottom wall 26 to at least partially define an interior of the container body 22. As shown in FIG. 1, the side wall 28 is preferably generally cylindrical, although the container body could have a rectangular shape or other shapes without departing from the scope of the present invention. The lid assembly 24 includes a lid body 30 and a door 32. As described below in more detail, the door 32 is pivotally connected to the lid body 30 for pivoting movement between open and closed positions. As shown in FIGS. 1–5, the lid body 30 preferably has a generally dome-shaped outer surface 34 that extends from a top portion 36 of the lid body 30 to a lower portion 38 of the lid body 30. The general dome-shape of the outer surface 34 is preferable because it directs rainwater thereover to the sides of the container body 22. However, the lid body 30 could have other configurations without departing from the scope of the present invention. The lower portion 38 of the lid body is shaped and adapted to rest on or fit over a generally annular upper rim (not shown) of the container body 22.

Figure 12:
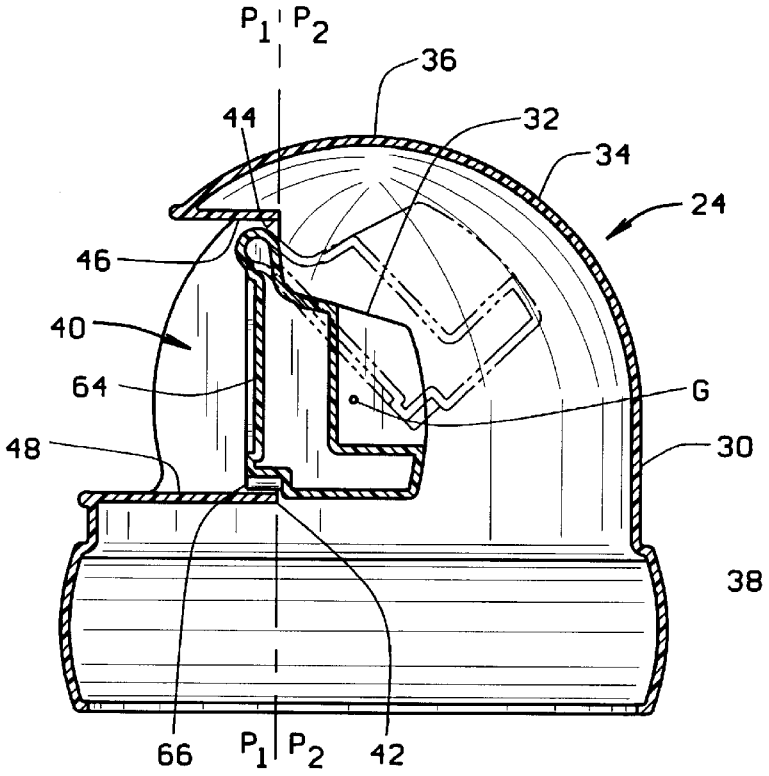
FIG. 12 is a cross-sectional view of the lid assembly taken along the plane of line 12—12 in FIG. 7.
Figure 13:
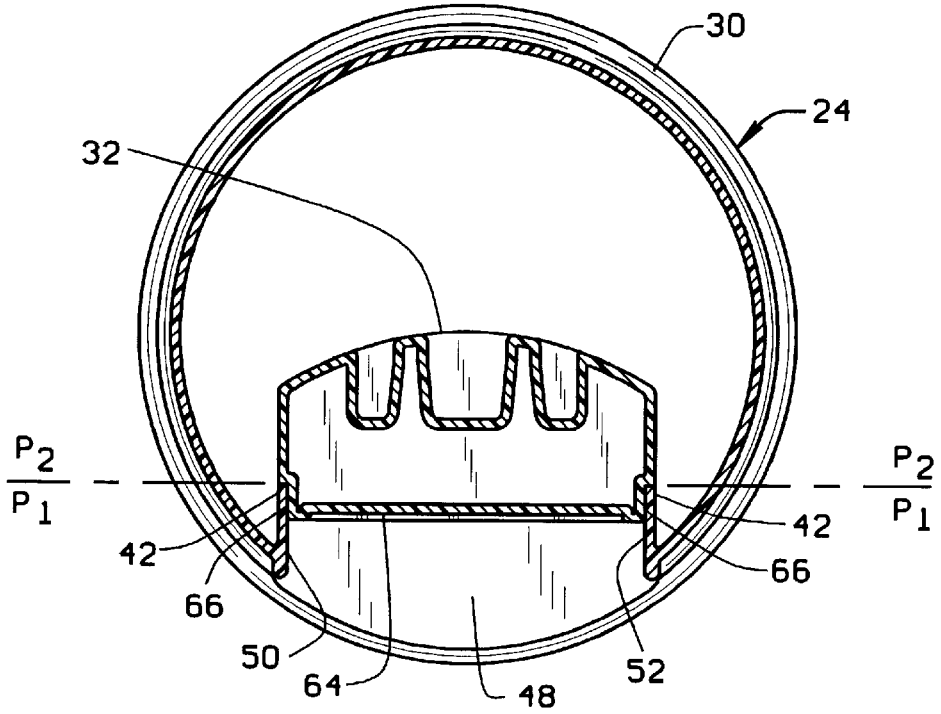
FIG. 13 is a cross-sectional view of the lid assembly taken along the plane of line 13—13 in FIG. 7.
Figure 14:
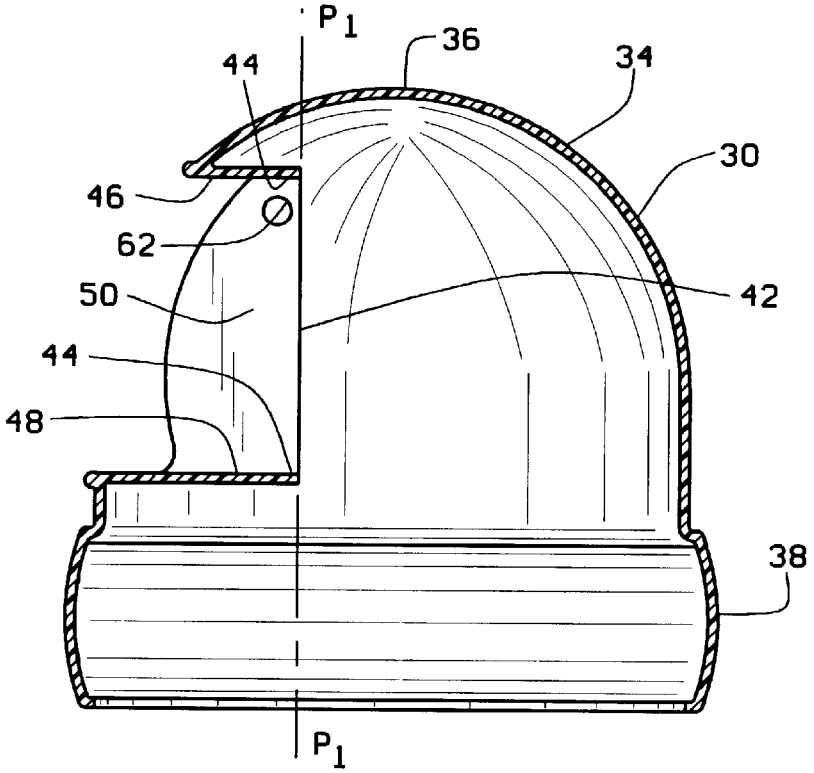
FIG. 14 is a partial cross-sectional view of the lid assembly taken along the plane of line 12—12 in FIG. 7, but shown without the door.

As best shown in FIGS. 12–14, the lid body 30 includes a flange 40 that extends inwardly from the outer surface 34 of the lid body 30. The flange 40 extends inwardly and terminates at an in inner rim 42 that at least partially defines an opening 44 in the lid body 30. Preferably, the flange 40 is a continuous flange that circumscribes the opening 44. In the preferred embodiment, the flange 40 includes a generally horizontal upper flange portion 46, a generally horizontal lower flange portion 48 (see FIGS. 12 and 14), a slightly canted left side flange portion 50 and a slightly canted right side flange portion 52 (see FIG. 13). Thus, the upper, lower, left side and right side flange portions 46, 48, 50 and 52 define a generally trapezoidal recess 54 in the lid body 30. Preferably, lid body 30 and the flange 40 are of a monolithic construction.

Figure 7:
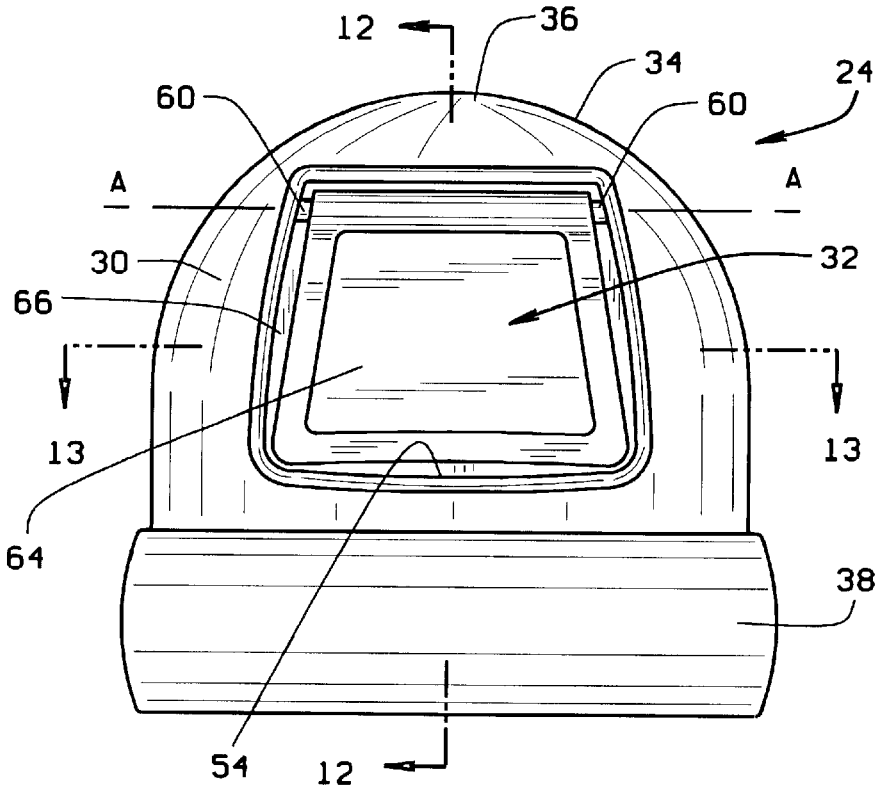
FIG. 7 is an enlarged view of a lid assembly of the container assembly of FIG. 1.

The door 32 is positioned adjacent the opening 44 in the lid body 30 and is pivotally connected to the flange 40 for selectively moving the door 32 between a closed position (shown in solid lines in FIGS. 12) and an open position (shown in phantom lines in FIG. 12) relative to the lid body 30. As shown in FIGS. 7, 12 and 13, the door 32 is adapted to substantially cover the opening 44 in the lid body 30 when it is in its closed position. The door 32 is mounted to the lid body 30 for pivoting movement about a pivot axis A (see FIGS. 7, 8 and 10). As shown in FIG. 12, the door is preferably configured so that a center of gravity G of the door 32 is spaced inwardly of (behind) the pivot axis A (above the pivot axis A in FIG. 10 and to the right of pivot axis A when viewed in FIG. 12) throughout the entire range of movement of the door 32. Preferably, the distance between the center of gravity G and the pivot axis A is sufficient so that gravity biases the door 32 toward its closed position.

Figure 8:
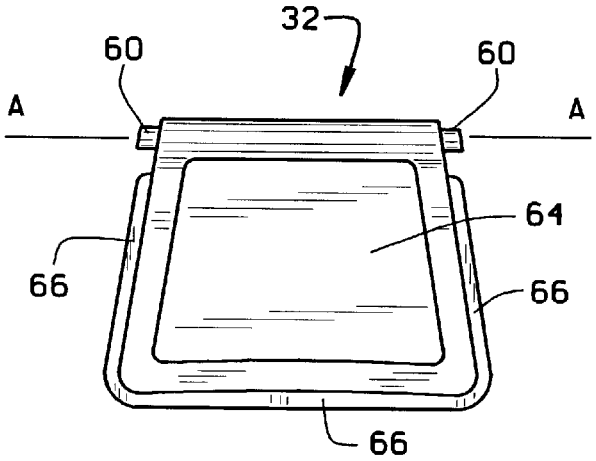
FIG. 8 is a front elevational view of a door of the container assembly of FIG. 1.
Figure 9:
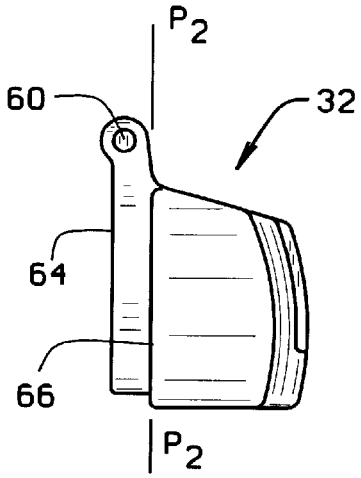
FIG. 9 is a right end elevational view of the door of FIG. 8, the left end elevational view being a mirror image thereof.
Figure 10:
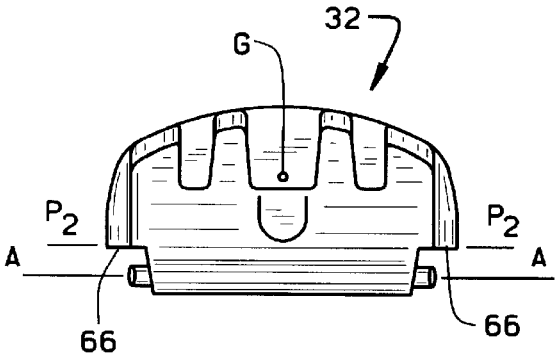
FIG. 10 is a top plan view of the door of FIG. 8.

As best shown in FIGS. 8–10, the door 32 preferably includes a pair of laterally opposite pivot pins 60, one extending from the left side of the door and one extending from the right side of the door. Preferably, the door 32 and the pivot pins 60 are of a monolithic construction. As shown in FIG. 14, the left side and right side flange portions 50 and 52 of the lid body 30 each include a notch or hole 62 sized to receive one of the pivot pins 60 in a manner to permit pivoting movement of the door 32 relative to the lid body 30. The pivot pins 60 and the notches 62 lie along the pivot axis A when the door 32 is mounted to the lid body 30. In an alternative embodiment (not shown), the flange may include a pair of pivot pins extending generally toward one another from the left side and right side flange portions, and the door may include a pair of notches or holes for receiving the pins.

The door 32 includes a generally flat frontal portion 64 and a rim engaging portion 66. As shown in FIG. 8, the rim engaging portion 66 preferably borders left, bottom and right sides of the frontal portion 64 of the door 32. In operation, a user can apply an inwardly directed force to the frontal portion 64 to move the door 32 toward its open position. As shown in FIGS. 12 and 13, the rim engaging portion 66 is adapted for engagement with the inner rim 42 of the flange 40 when the door 32 is in its closed position. The opening 44 is preferably sized so that the frontal portion 64 of the door 32 passes at least partially through the opening 44 as the door 32 moves outwardly from its open position toward its closed position. Thus, the frontal portion 64 of the door 32 is positioned slightly outside of the inner rim 42 (to the left of the inner rim 42 as viewed in FIG. 12) when the door 32 is in its fully closed position. Also, as shown in FIG. 12, the door 32 and the flange 40 of the lid body 30 are preferably configured so that the pivot axis A is parallel to and spaced outwardly from an imaginary vertical plane that passes through at least a portion of the inner rim 42. In other words, preferably, the pivot axis A is positioned outwardly from at least a portion of the inner rim 42 (to the left of at least a portion of the inner rim 42 as viewed in FIG. 12, and below at least a portion of the inner rim 42 as viewed in FIG. 13).

Figure 11:
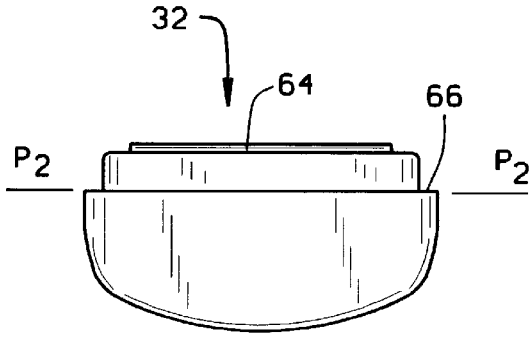
FIG. 11 is a bottom plan view of the door of FIG. 8.

In the preferred embodiment of the invention, the inner rim 42 of the flange 40 generally defines a first plane $P_1$ (see FIG. 14), and the rim engaging portion 66 of the door 32 generally defines a second plane $P_2$ (see FIGS. 9–11), so that the planes $P_1$ and $P_2$ are generally coplanar when the door 32 is in its closed position (see FIGS. 12 and 13. The pivot axis A is preferably spaced outwardly from the plane $P_1$ (to the left of $P_1$ when viewed in FIG. 12).

As described above, in the preferred embodiment of the invention, the lid body 30 and the door 32 are each of a monolithic (i.e., one-piece) construction. Preferably, the lid assembly 24 is a two-piece assembly consisting solely of the monolithic lid body 30 and the monolithic door 32, with the door 32 being pivotally connected directly to the lid body 30. However, alternatively, the lid assembly 24 could comprise more than two components without departing from the scope of the present invention. For example, in an alternative embodiment, the notches 62 in the flange 40 may include bearing inserts or sleeves (not shown) that are adapted receive the pivot pins 60 of the door 32. In another embodiment, the pivot pins 60 and door 32 could be separate components.

As shown in FIGS. 1–4 and 6, the container body 22 further comprises a boss 70 extending from an exterior surface of the container side wall 28. Preferably, the boss 70 generally has a partial-ring shape. The boss 70 includes a hole 72 sized and adapted to receive a portion of a retaining member (not shown) for securing the waste container assembly 20 to a secure object (not shown). As shown in the Figures, in the preferred embodiment of the invention, the boss 70 protrudes from the side wall 28 adjacent the bottom wall 26 of the container body 22. Preferably, the hole 72 passes completely through the boss 70 so that a retaining member, such as a chain, rope, cable or other tether-like member, can be easily threaded therethrough for anchoring or securing the waste container assembly 20 to a secure object, such as a tree trunk, lamp post, or fence post. In this way, the waste container assembly 20 can be easily secured from theft or high winds. Preferably, the boss 70 and the container body 22 are of a monolithic construction.

In the preferred embodiment, the exterior surface of the container side wall 28 includes a horizontal groove 74 extending generally tangentially along the side wall 28 adjacent the boss 70. As shown in the Figures, the boss 70 and the groove 74 are positioned relative to one another so that the boss 70 and the groove 74 together define the hole 72. Preferably, the groove 74 is sized to accommodate a portion of the retaining member that passes through the hole 72.

In the preferred embodiment of the invention, all components of the waste container assembly 20 are of polymeric materials, such as polyethylene, and are molded by conventional methods. However, some or all of the components of the waste container assembly 20 could be of other polymeric or non-polymeric materials without departing from the scope of the invention. With the door 32, pivot pins 60, flange 40 and lid body 30 being entirely of polymeric materials, operation of the door is relatively quiet as compared to assemblies made of metal components, making it suitable for use in quiet places, such as hospitals and libraries. Also, because the door 32 is weighted so as to be "self-closing," no springs are necessary. The polymeric materials from which the various components of the waste container assembly 20 are constructed are also particularly suitable for use outdoors, where the assembly may be subjected to adverse weather conditions for extended periods of time.

As described above, the lid assembly 24 is preferably a two-piece assembly consisting solely of the monolithic lid body 30 and the monolithic door 32, with the door 32 being pivotally connected directly to the lid body 30. Preferably, the door 32 can be removed from the lid body 30 by pressing one or both of the left side and right side flange portions 50 and 52 away from one another far enough to allow one of the pivot pins 60 to be removed from the notches 62. The door 32 can be installed in the same fashion. The various components of the waste container assembly 20, may be available in a plurality of colors so that they can mixed and matched in various color combinations, if desired. Preferably, the polymeric materials from which the flange 40 is made are sufficiently flexible to allow the left side and right side flange portions 50 and 52 to be flexed by hand to install and remove the door 32 without tools. This allows a user to easily remove the door 32 and replace it with a different colored door 32, if desired.

In view of the above, it will be seen that the objects of the invention have been achieved in other advantageous results attained. As various changes could be made without departing from the scope of the invention, it is intended that all matter contained in the above description or shown in the accompanying drawings shall be interpreted as illustrative and not in a limiting sense.

What is claimed is:

1. A waste container assembly comprising:

a container body having an upper rim;

a lid body having an outer surface extending from a top of the lid body to a lower portion of the lid body, the lower portion of the lid body being shaped and adapted for engagement with the upper rim of the container body;

a flange extending from the lid body, the flange extending inwardly toward a central longitudinal axis of the waste container, the flange having an inner rim that at least partially defines an opening in the lid body , the inner rim of the flange being a continuous rim circumscribing the opening and having side portions, a top portion and a bottom portion, the inner rim of the flange lying in a first plane; and a door positioned adjacent the opening in the lid body, the door being pivotally connected to the flange at a pivot location for selectively moving the door between open and closed positions relative to the lid body, the pivot location being spaced outwardly of the first plane, the door being adapted to substantially cover the opening in the lid body which the door is in its closed position, the door including a rim engaging portion sized and adapted to engage the side portions and the bottom portion of the inner rim of the flange when the door is in its closed position, the rim engaging portion lying in a second plane, the first and second planes being generally coplanar when the door is in its closed position;

wherein the lid body and door being shaped and adapted so that the door is recessed from the outer surface of the lid body when the door is in its closed position, and wherein the center of gravity of the door is located inwardly of the first plane, when the door is in the closed position.

2. The waste container assembly of claim 1 wherein the door includes a pair of laterally opposite pivot pins and wherein the flange includes a left flange portion, a bottom flange portion and a right flange portion, the left and right flange portions each having an edge defining a hole sized to receive one of the pivot pins in a manner to permit pivoting movement of the door relative to the lid body, each edge completely circumscribing its corresponding hole.

3. The waste container assembly of claim 2 wherein the door and the pivot pins are of a monolithic construction.

4. The waste container assembly of claim 2 wherein the pivot pins and notches lie along a pivot axis, the pivot axis being generally parallel to the first and second planes, the door and the lid body being configured so that pivot axis is spaced outwardly from the first plane.

5. The waste container assembly of claim 4 wherein the door is configured so that a center of gravity of the door is spaced inwardly from the pivot axis a distance sufficient so that gravity biases the door toward its closed position.

6. The waste container assembly of claim 5 wherein all components of the waste container assembly are entirely of polymeric materials.

7. The waste container assembly of claim 1 wherein the lid body and the flange are of a monolithic construction.

8. The waste container assembly of claim 1 wherein all components of the waste container assembly are entirely of polymeric materials.

9. The waste container assembly of claim 1 wherein the container body has a bottom and at least one side wall extending upwardly from the bottom, the side wall at least partially defining a container interior, the side wall having an exterior surface with a boss extending therefrom, the boss having a hole unimpeded by any portion of the waste container wherein the hole is adapted to receive a portion of a retaining member for anchoring the waste container assembly to a secure object to thereby prevent theft of the waste container.

10. The waste container assembly of claim 1 wherein one of the door and lid body includes a pair of laterally opposite pivot pins and wherein the other of the door and lid body includes a pair of notches, the pivot pins and notches lying along the pivot axis, each notch being sized to receive one of the pivot pins in a manner to permit pivoting movement of the door relative to the lid body.

11. A waste container assembly comprising:

a container body having a bottom and at least one side wall extending upwardly from the bottom, the side wall at least partially defining a container interior;

a lid body having an outer surface extending from a top of the lid body to a lower portion of the lid body, the lower portion of the lid body being shaped and adapted for engagement with the upper rim of the container body;

a flange extending from the lid body, the flange having an inner rim that at least partially defines an opening in the lid body;

a door positioned adjacent the opening in the lid body, the door being pivotally connected to the flange for selectively moving the door between open and closed positions relative to the lid body, the door being adapted to substantially over the opening in the lid body when the door is in its closed position; and a boss extending outwardly from an exterior surface of the container side wall the boss having a hole passing completely therethrough and being un-impeded by any portion of the waste container wherein the hole is sized and adapted to receive a tether therethrough for anchoring the waste container assembly to a secure object to thereby prevent theft of the waste container body, the exterior surface of the container side wall including a generally tangential groove extending along a portion of the container side wall adjacent the boss, the boss being positioned relative to the groove so that the hole is defined by the surface of the groove and the boss.

12. The waste container assembly of claim 11 wherein the boss and the container body are of a monolithic construction.

13. The waste container assembly of claim 11 wherein the boss and the container body are entirely of a polymeric materials.

14. The waste container assembly of claim 11 wherein the lid body is monolithic and the door is monolithic, and wherein the lid assembly is entirely of polymeric materials.

* * * * *

UNITED STATES PATENT AND TRADEMARK OFFICE

CERTIFICATE OF CORRECTION

PATENT NO. : 6,173,861 B1
DATED : January 16, 2001
INVENTOR(S) : Robert L. Houry It is certified that error appears in the above-identified patent and that said Letters Patent is hereby corrected as shown below:

Column 6,
Line 37, replace "which" with -- when --.

Signed and Sealed this

Ninth Day of October, 2001

*Attest:*

Nicholas P. Godici

*Attesting Officer*

NICHOLAS P. GODICI
*Acting Director of the United States Patent and Trademark Office*